US012320578B2

(12) United States Patent
Edake et al.

(10) Patent No.: US 12,320,578 B2
(45) Date of Patent: Jun. 3, 2025

(54) REFRIGERATOR AND CORRESPONDING SHELVING SYSTEM

(71) Applicant: WHIRLPOOL CORPORATION, Benton Harbor, MI (US)

(72) Inventors: Mahesh Edake, Pune (IN); Ravindra Mali, Pune (IN); Kailash More, Pune (IN); Lalit Madhukar Suryawanshi, Pune (IN); Kiran Waghmare, Hingoli (IN)

(73) Assignee: Whirlpool Corporation, Benton Harbor, MI (US)

( * ) Notice: Subject to any disclaimer, the term of this patent is extended or adjusted under 35 U.S.C. 154(b) by 291 days.

(21) Appl. No.: 18/296,725

(22) Filed: Apr. 6, 2023

(65) Prior Publication Data

US 2024/0337434 A1 Oct. 10, 2024

(51) Int. Cl.
*F25D 25/02* (2006.01)

(52) U.S. Cl.
CPC ..... *F25D 25/02* (2013.01)

(58) Field of Classification Search
CPC . F25D 25/02; F25D 2325/022; A47B 96/021; A47B 96/062; A47B 96/027
USPC ..... 312/408, 410, 404, 351; 108/108; 211/134, 85.4
See application file for complete search history.

(56) References Cited

U.S. PATENT DOCUMENTS 4,736,997 A * 4/1988 Besore ..... A47F 5/005 312/236
4,960,308 A * 10/1990 Donaghy ..... F25D 25/025 D15/89
5,273,354 A 12/1993 Herrmann et al.
5,540,493 A 7/1996 Kane et al.
5,735,589 A 4/1998 Herrmann et al.
6,045,101 A * 4/2000 Goyette ..... A47B 13/083 248/235
8,814,287 B2 8/2014 Jang
9,250,010 B2 2/2016 De La Garza et al.
9,259,088 B1 * 2/2016 Mobley ..... A47B 96/024
9,504,324 B2 * 11/2016 McMillin ..... A47B 57/34
9,945,601 B1 * 4/2018 Bhavsar ..... B29C 45/14336
10,823,490 B2 * 11/2020 Kumar ..... F25D 23/067
10,935,305 B1 3/2021 Bassler et al.
11,140,985 B2 * 10/2021 Chavan ..... A47F 3/0486
2005/0218767 A1 10/2005 Jeong et al.
2010/0181884 A1 * 7/2010 De La Garza ..... F25D 25/024 29/428
2011/0115356 A1 5/2011 Nash et al.
(Continued)

FOREIGN PATENT DOCUMENTS

CA 2140604 A1 7/1996
CN 102661651 A 9/2012
(Continued)

OTHER PUBLICATIONS

CN104764282 English translation (Year: 2017).*

*Primary Examiner* — Janet M Wilkens
(74) *Attorney, Agent, or Firm* — Brooks Kushman P.C.

(57) ABSTRACT

A refrigerator shelf includes a plate, a frame, and a cover. The plate is configured to support items disposed within a refrigerator. The frame is configured to support the plate. The frame has a front beam, a rear beam, a first side beam, and a second side beam, each engaging and supporting the plate. The cover is secured to the front beam.

20 Claims, 12 Drawing Sheets

(56) References Cited

U.S. PATENT DOCUMENTS

| | | | | |
|---|---|---|---|---|
| 2012/0126679 | A1* | 5/2012 | Bai | F25D 25/02 211/134 |
| 2015/0153099 | A1* | 6/2015 | Nash | B23P 19/04 211/85.4 |
| 2015/0292794 | A1* | 10/2015 | Bienick | A47B 96/062 108/42 |
| 2015/0342350 | A1* | 12/2015 | Sankhgond | A47B 96/024 248/249 |
| 2021/0055041 | A1 | 2/2021 | Staud et al. | |

FOREIGN PATENT DOCUMENTS

| | | | | | |
|---|---|---|---|---|---|
| CN | 104764282 | B | * | 9/2017 | |
| CN | 115247937 | A | * | 10/2022 | |
| DE | 102008063390 | A1 | * | 7/2010 | F25D 25/02 |
| DE | 102011085428 | A1 | * | 5/2013 | F24C 15/16 |
| KR | 100985944 | B1 | * | 10/2010 | |
| KR | 101461962 | B1 | | 11/2014 | |
| KR | 101510695 | B1 | | 4/2015 | |
| WO | WO-2018204215 | A1 | * | 11/2018 | F25D 25/02 |
| WO | WO-2023274713 | A1 | * | 1/2023 | A47B 95/04 |

* cited by examiner

REFRIGERATOR AND CORRESPONDING SHELVING SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelf includes a plate, a frame, and a cover. The plate is configured to support items disposed within a refrigerator. The frame is configured to support the plate. The frame has a front beam, a rear beam, a first side beam, and a second side beam. The plate is disposed on top of an upper surface that is collectively formed by the front beam, the rear beam, the first side beam, and the second side beam. The rear beam defines a C-channel above the upper surface receiving a rearward edge of the plate to restrict movement of the plate in a vertical direction and to restrict movement of the plate in a direction extending from the front beam toward the rear beam. The cover engages a forward edge of the front beam, engages a forward edge of the plate to restrict movement of the plate in a direction extending from the rear beam toward the front beam, and has an overhang engaging a top of the plate to further restrict movement of the plate in the vertical direction.

A refrigerator shelf includes a plate, a frame, and a cover. The plate is configured to support items disposed within a refrigerator. The frame is disposed about a periphery of the plate. The frame has a front beam, a rear beam, a first side beam, and a second side beam. The front beam is spaced-apart from the rear beam. The first side beam is spaced-apart from the second side beam. The front beam and rear beam each span and are each secured to the first and second side beams such that a central opening is defined between the front beam, rear beam, first side beam, and second side beam. The rear beam, first side beam, and second side beam collectively define a C-channel configured to receive the plate. The front beam defines a slot configured to guide the plate in a direction extending from the front beam toward the rear beam and into the C-channel during installation. The plate is disposed within the C-channel and at least partially in the slot. The plate spans the front beam and rear beam and spans first and second side beams such that the plate is disposed within an entirely of the central opening. The cover is secured to a forward edge of the front beam and covers the slot such that the cover restricts movement of the plate out of the slot and in a direction extending from the rear beam toward the front beam and secures the position of the plate within the C-channel and slot.

A refrigerator shelf includes a plate, a frame, and an edge cover. The plate is configured to support items disposed within a refrigerator. The frame is configured to support the plate. The frame has a front beam, a rear beam, a first side beam, and a second side beam. The front beam engages a portion of the outer peripheral edge of the plate. The edge cover is secured to a forward edge of the front beam. The edge cover defines keyed-orifices. The front beam includes keyed-protrusions that engage the keyed-orifices to secure the edge cover to the front beam.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
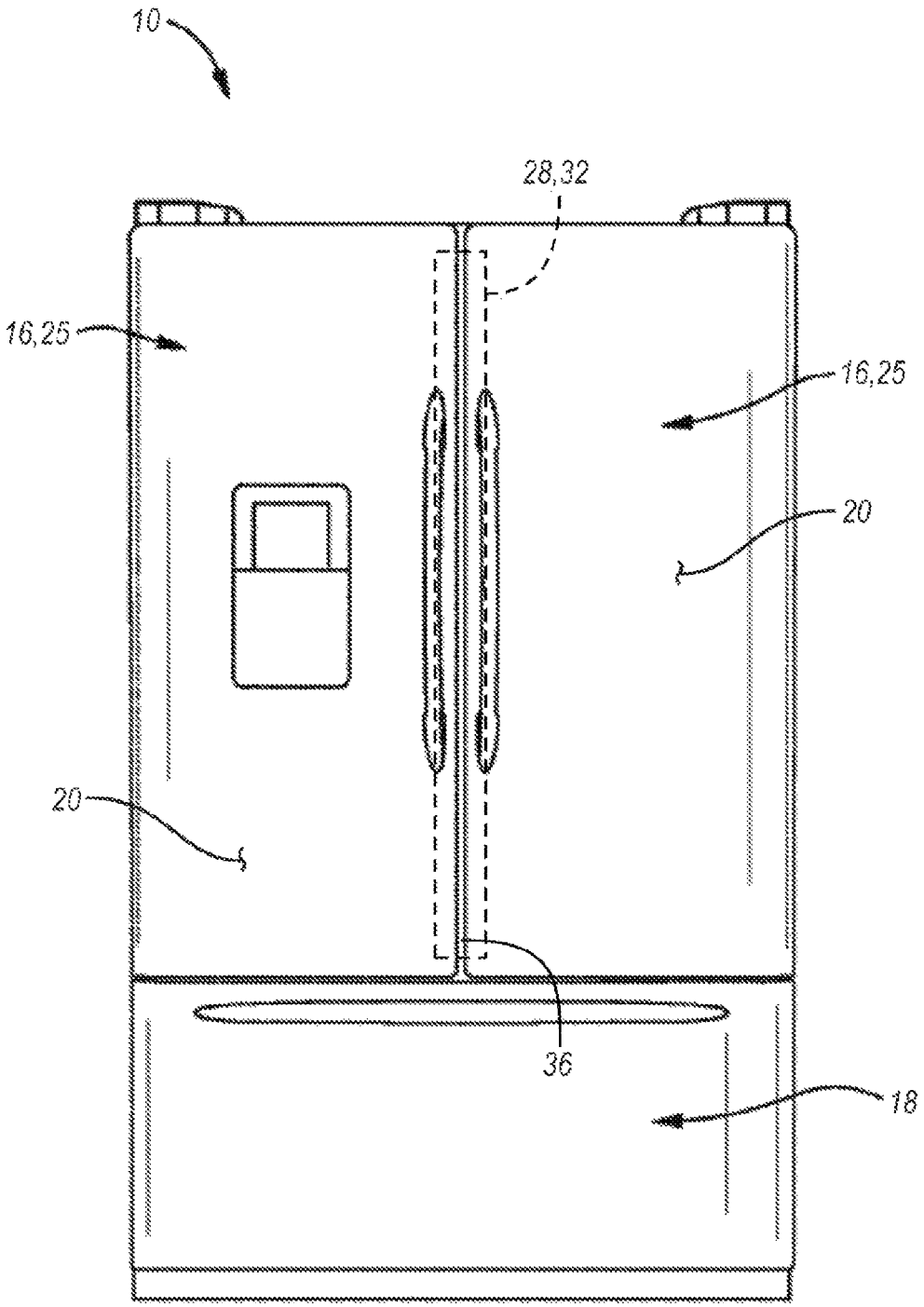
FIG. 1 is an elevated front view of a French-Door Bottom Mount type refrigerator appliance.
Figure 2:
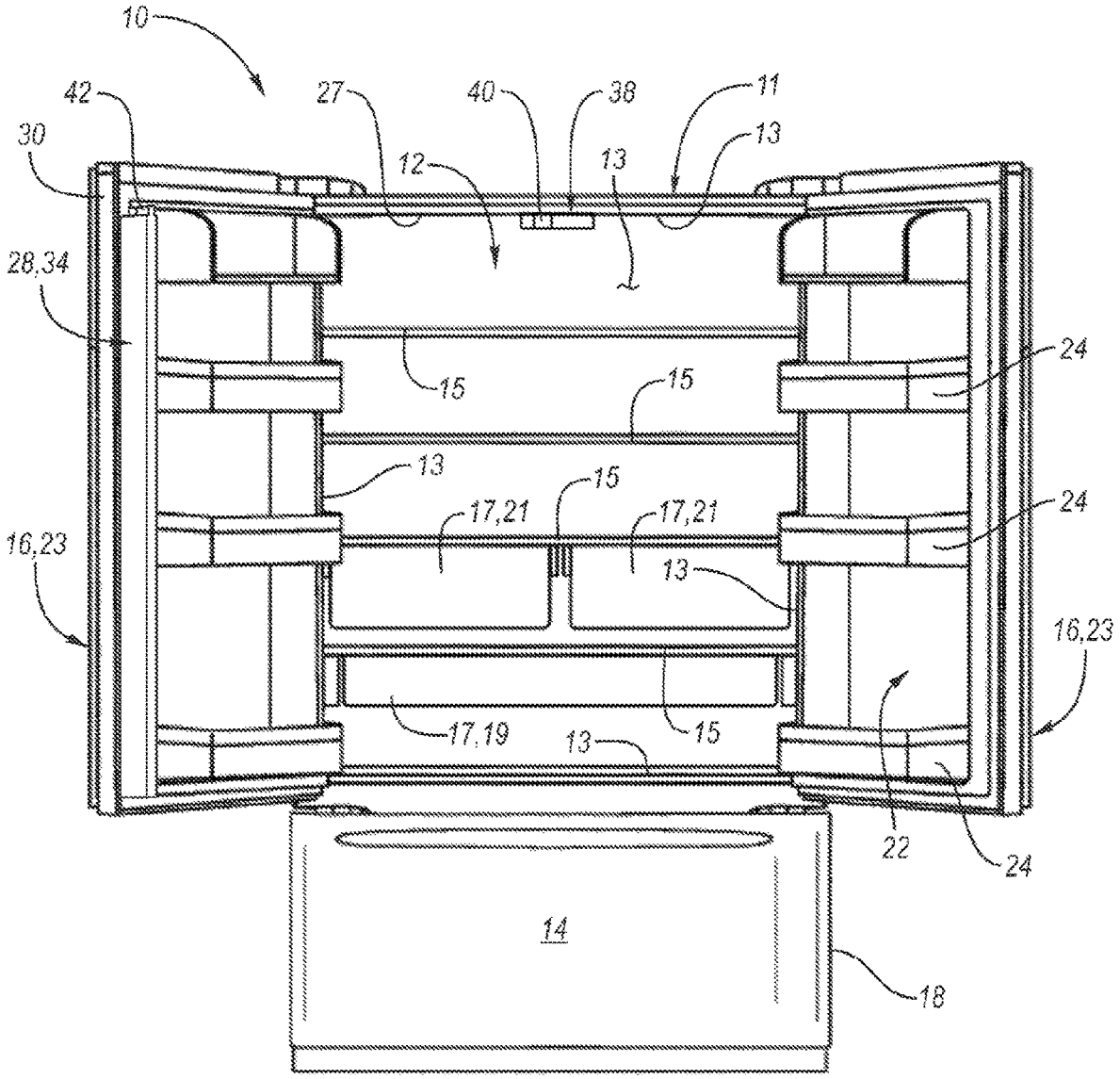
FIG. 2 is an elevated front view of a French-Door Bottom Mount type refrigerator with the refrigerator compartment doors open.
Figure 3:
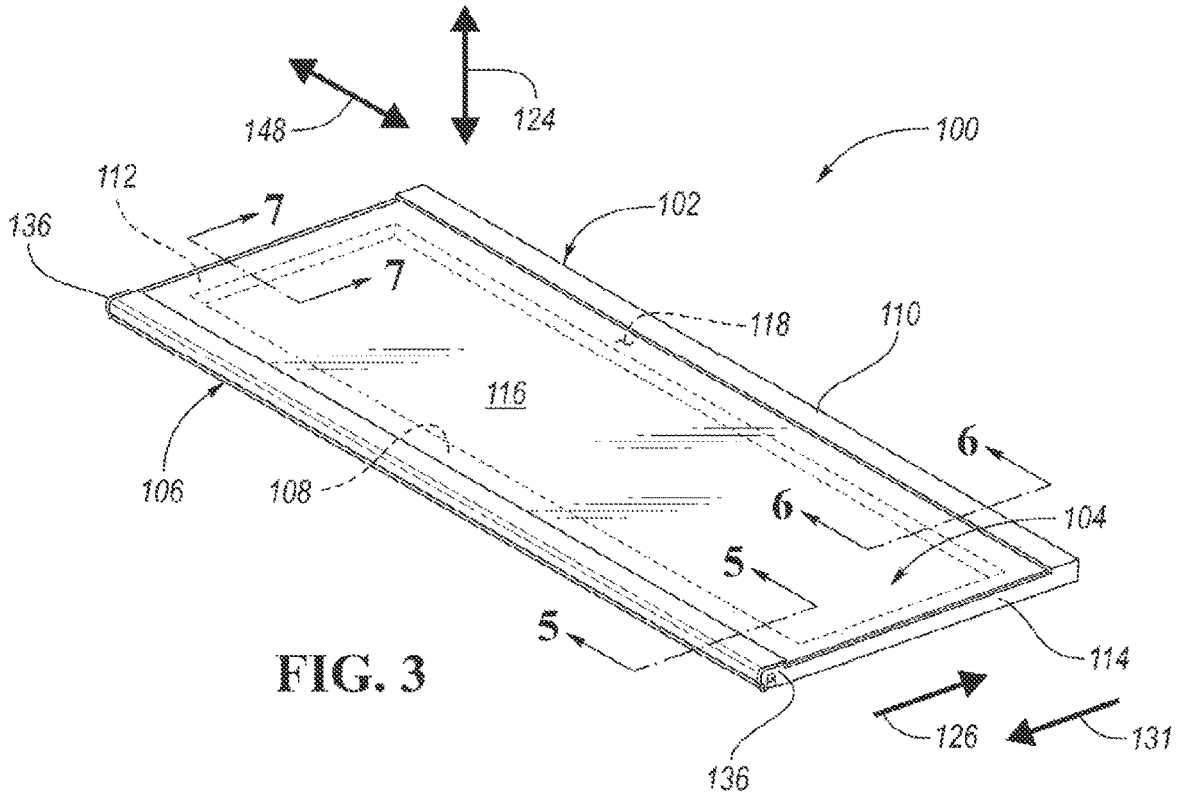
FIG. 3 is a top isometric view of a first embodiment of a refrigerator shelf.
Figure 4:
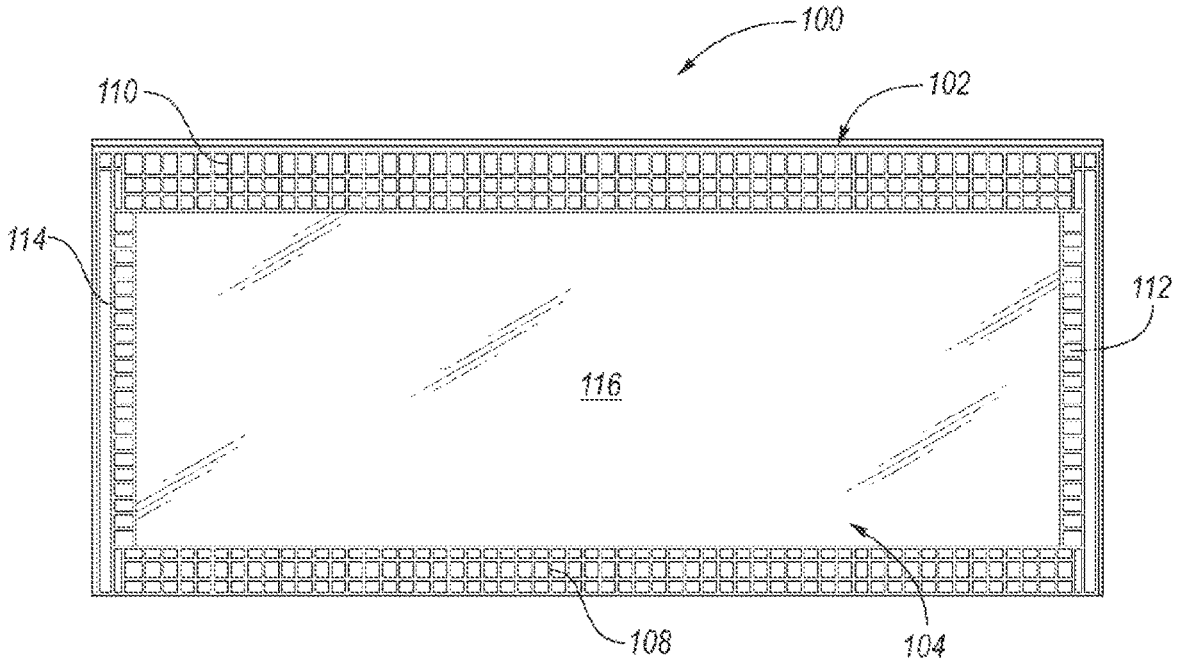
FIG. 4 is a bottom view of the first embodiment of the refrigerator shelf.
Figure 5:
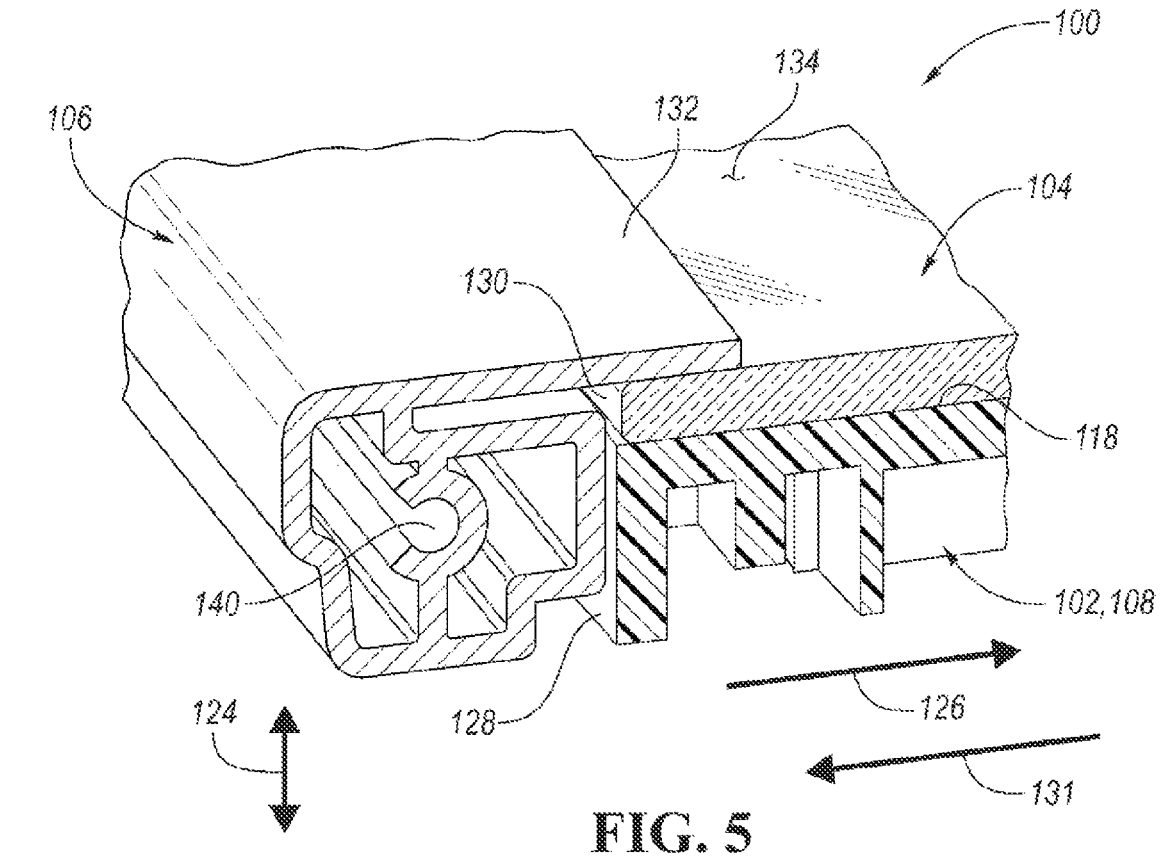
FIG. 5 is a cross-sectional view taken along line 5-5 in FIG. 3.
Figure 6:
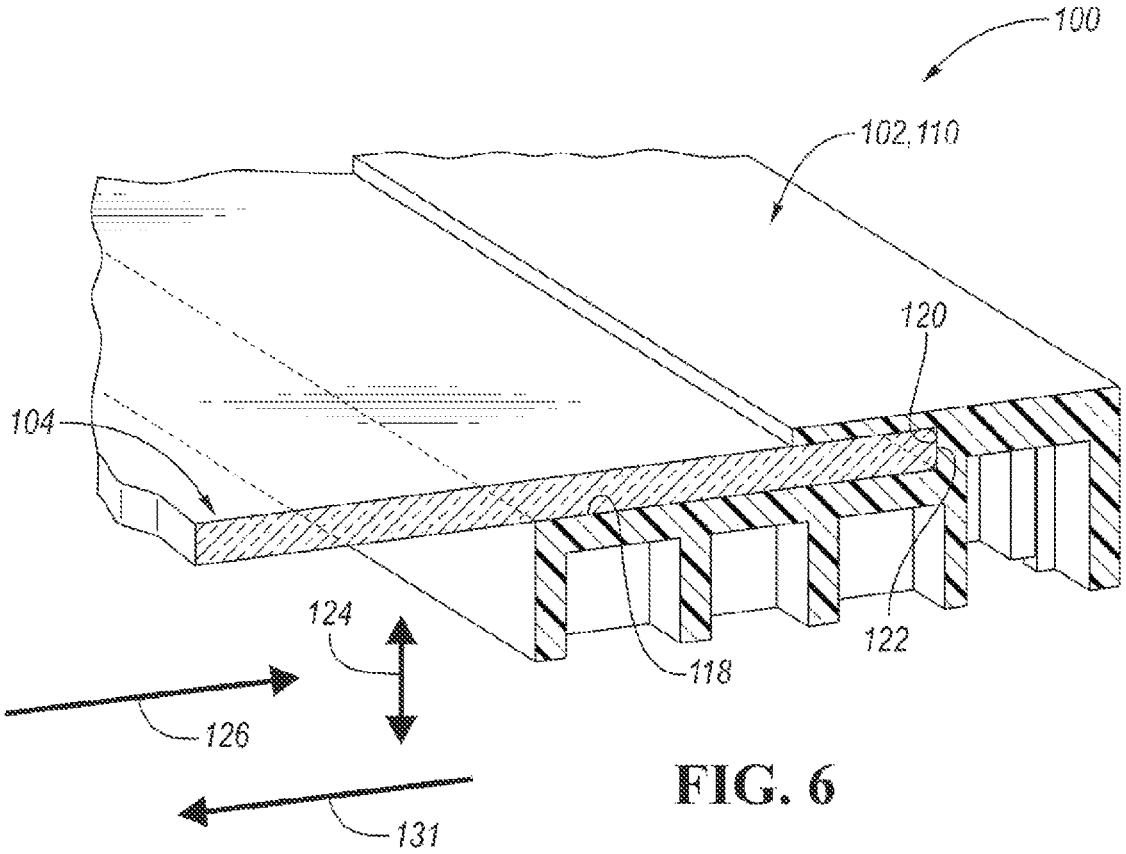
FIG. 6 is a cross-sectional view taken along line 6-6 in FIG. 3.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a cabinet 11 or housing defining a first internal storage chamber, internal cavity, or fresh food compartment 12 configured to refrigerate and not freeze consumables or foodstuffs within the fresh food compartment 12, and a second internal storage chamber, internal cavity, or a freezer compartment 14 configured to freeze consumables or foodstuffs within the freezer compartment 14 during normal use. The refrigerator 10 includes panels or walls 13 that form the cabinet 11 or housing and define the fresh food compartment 12 and the freezer compartment 14. The walls 13 may more specifically form an internal liner of the refrigerator 10. The walls 13 may include a rear or back wall, a top wall, a bottom wall, and two side walls.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. The doors 16 may be configured to transition between open positions 23 and closed positions 25. The doors 16 may cover an opening 27 to the internal cavity (e.g., fresh food compartment 12) in the closed positions 25. The doors 16 may provide access to the internal cavity via the opening 27 in the open positions 23. It may also be shown that the fresh food compartment 12 may only have one door 16 as opposed to two doors 16 as illustrated. The doors 16 may be rotatably secured to the cabinet 11 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-8, a first embodiment of a refrigerator shelf 100 is illustrated. The shelf 100 may be utilized as a shelf within a compartment of the refrigerator 10 (e.g., the fresh food compartment 12 or the freezer compartment 14). For example, the shelf 100 may be utilized as shelf 15 illustrated in FIG. 2. The shelf 100 includes a frame 102, a panel or plate 104 (e.g., a glass plate) that is configured to support items (e.g., food items) that are disposed within the refrigerator 10, and a trim or edge cover 106. The frame 102 provides structural support for the plate 104 and has a configuration so that the top surface area of the plate 104 is maximized (which maximizes the number of items that may be placed on the top of the plate 104) and so that the plate 104 has sufficient structure to support the load of the items placed on the top of the plate 104. This configuration allows for a single shelf having a single support plate (as opposed to multiple spaced-apart shelves or plates) to be utilized, where the single shelf may span an entire width of a compartment of the refrigerator 10 (e.g., the fresh food compartment 12 or the freezer compartment 14).

The frame 102 includes a front beam 108, a rear beam 110, a first side beam 112, and a second side beam 114. A bottom of the frame 102 (including bottoms of each of the front beam 108, rear beam 110, first side beam 112, and second side beam 114) may include ribs that increase the structural rigidity of the frame 102. The front beam 108 is spaced-apart from the rear beam 110. The first side beam 112 is spaced-apart from the second side beam 114. The front beam 108 and rear beam 110 each span and are each secured to the first and second side beams 112, 114 such that a central opening 116 is defined between the front beam 108, rear beam 110, first side beam 112, and second side beam 114. The plate 104 spans the front beam 108 and rear beam 110, and spans first and second side beams 112, 114 such that the plate 104 is disposed within an entirely of the central opening 116. The first and second side beams 112, 114 may be mirror images of each other.

The plate 104 is disposed on top of an upper surface 118 that is collectively formed by the front beam 108, the rear beam 110, the first side beam 112, and the second side beam 114. The rear beam 110 defines a C-channel 120 above the upper surface 118 that receives a rearward edge 122 of the plate 104. The C-channel 120 may restrict movement of the plate 104 in a vertical direction 124, particularly along the rearward edge 122 of the plate 104, and may restrict movement of the plate 104 in a direction 126 extending from the front beam 108 toward the rear beam 110.

Figure 8:
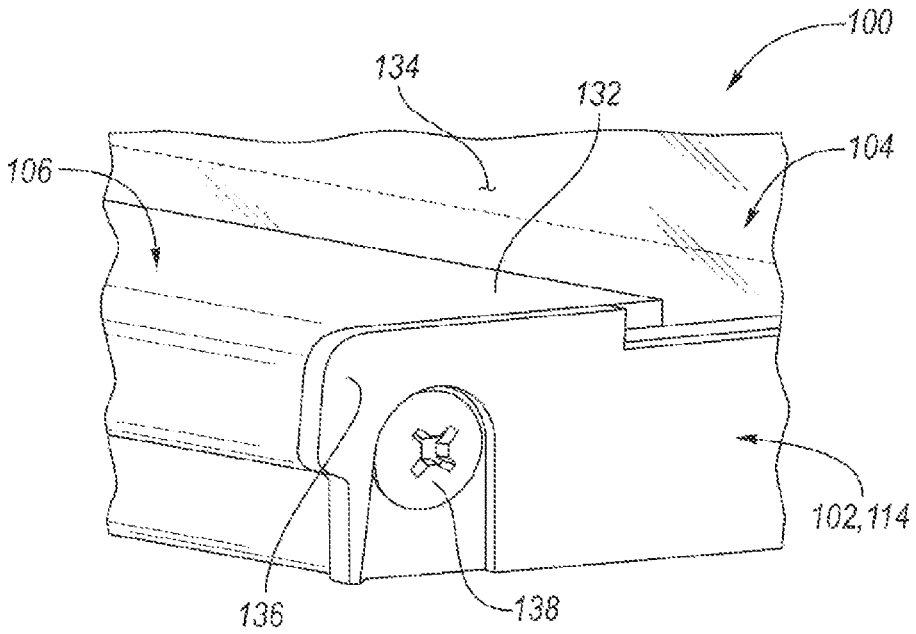
FIG. 8 is a magnified view of a front corner of the first embodiment of the refrigerator shelf.
Figure 9:
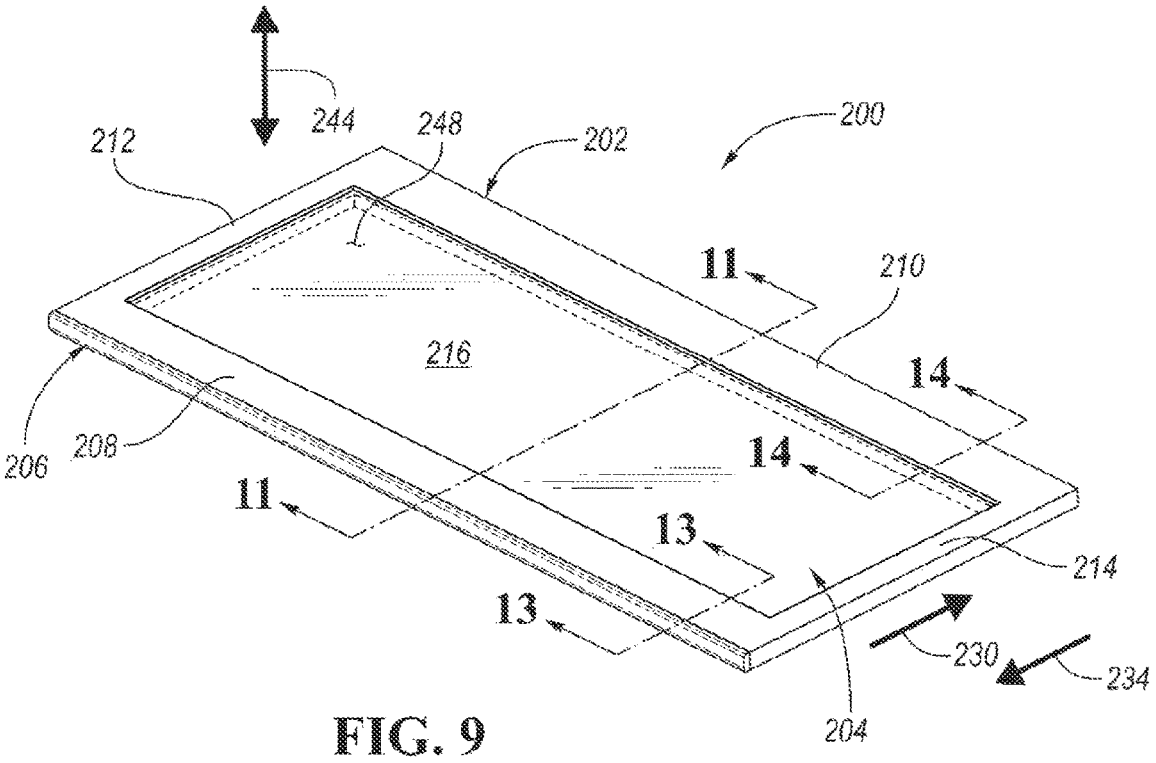
FIG. 9 is a top isometric view of a second embodiment of a refrigerator shelf.
Figure 10:
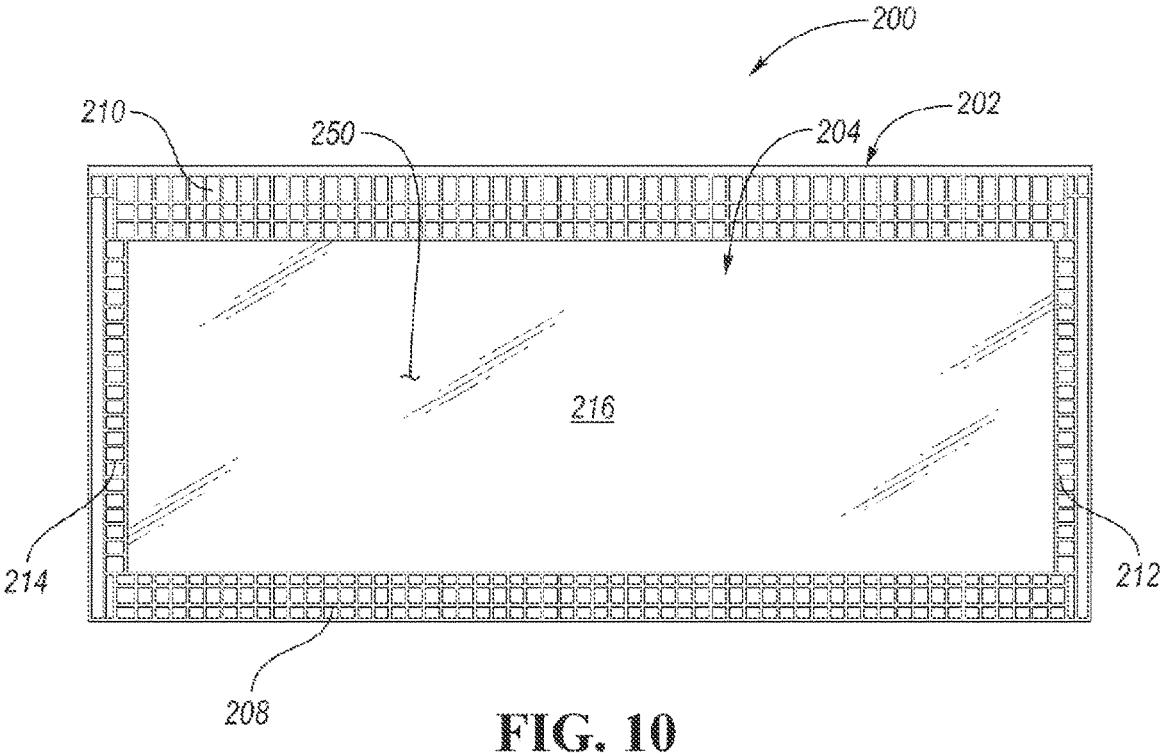
FIG. 10 is a bottom view of the second embodiment of the refrigerator shelf.

The edge cover 106 engages a forward edge 128 of the front beam 108. The edge cover 106 also engages a forward edge 130 of the plate 104 to restrict movement of the plate 104 in a direction 131 extending from the rear beam 110 toward the front beam 108. The edge cover 106 has an overhang 132 engaging a top or top surface 134 of the plate 104 to further restrict movement of the plate 104 in the vertical direction 124, particularly along the forward edge 130 of the plate 104. The forward edge 130 of the plate 104 is sandwiched between the overhang 132 and the upper surface 118 along the front beam 108. A pair of opposing tabs 136 extend forward from the from the first and second side beams 112, 114 along opposing ends of the front beam 108. The edge cover 106 is secured to the opposing tabs 136 via fasteners 138 extending into lateral sides of the edge cover 106. The edge cover 106 may defines orifices 140 configured to receive the fasteners 138. The opposing tabs 136 may also define orifices that the fasteners 138 extend into and about which heads of the fasteners 138 engage the opposing tabs 136. The fasteners 138 may be self-tapping fasteners. It is noted that the first side beam 112 may have the same structure as the second side beam 114 and any corresponding components (e.g., tab 136, fastener 138, etc.) may be part of or interact with the first side beam 112 similar to what is illustrated in FIG. 8, with the exception being that the first side beam 112 may be a mirror image of the second side beam 114.

Figure 7:
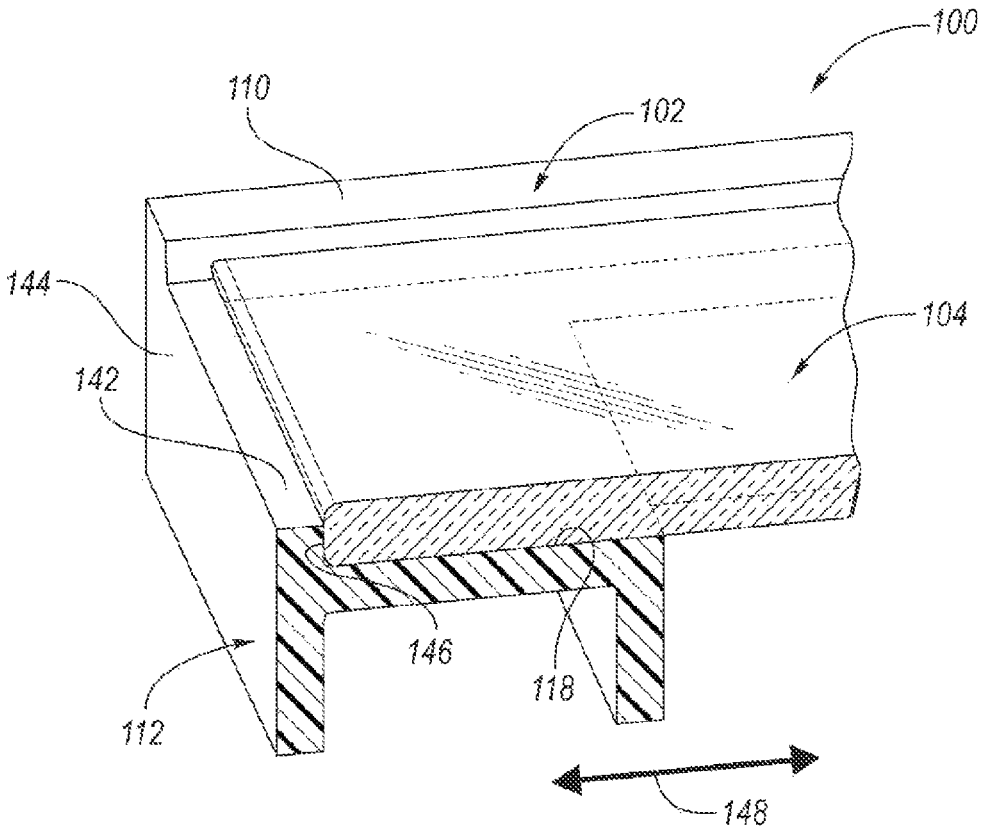
FIG. 7 is a cross-sectional view taken along line 7-7 in FIG. 3.

The frame 102 may further include ridges 142 that extend upward from the upper surface 118 along edges 144 of the first and second side beams 112, 114. The ridges 142 engage lateral edges 146 of the plate 104 to restrict movement of the plate 104 in a direction 148 extending between the first and second side beams 112, 114. It is noted that the second side beam 114 may have the same structure as the first side beam 112 and any corresponding components (e.g., ridge 142, lateral edges 146 of the plate 104, etc.) may be part of or interact with the second side beam 114 similar to what is illustrated in FIG. 7, with the exception being that the second side beam 114 may be a mirror image of the first side beam 112.

Referring to FIGS. 9-14, a second embodiment of a refrigerator shelf 200 is illustrated. The shelf 200 may be utilized as a shelf within a compartment of the refrigerator 10 (e.g., the fresh food compartment 12 or the freezer compartment 14). For example, the shelf 200 may be utilized as shelf 15 illustrated in FIG. 2. The shelf 200 includes a frame 202, a panel or plate 204 (e.g., a glass plate) that is configured to support items (e.g., food items) that are disposed within the refrigerator 10, and a trim or edge cover 206. The frame 202 provides structural support for the plate 204 and has a configuration so that the top surface area of the plate 204 is maximized (which maximizes the number of items that may be placed on the top of the plate 204) and so that the plate 204 has sufficient structure to support the load of the items placed on the top of the plate 204. This configuration allows for a single shelf having a single support plate (as opposed to multiple spaced-apart shelves or plates) to be utilized, where the single shelf may span an entire width of a compartment of the refrigerator 10 (e.g., the fresh food compartment 12 or the freezer compartment 14).

The frame 202 includes a front beam 208, a rear beam 210, a first side beam 212, and a second side beam 214. A bottom of the frame 202 (including bottoms of each of the front beam 208, rear beam 210, first side beam 212, and second side beam 214) may include ribs that increase the structural rigidity of the frame 202. The front beam 208 is spaced-apart from the rear beam 210. The first side beam 212 is spaced-apart from the second side beam 214. The front beam 208 and rear beam 210 each span and are each secured to the first and second side beams 212, 214 such that a central opening 216 is defined between the front beam 208, rear beam 210, first side beam 212, and second side beam 214. The plate 204 spans the front beam 208 and rear beam 210, and spans first and second side beams 212, 214 such that the plate 204 is disposed within an entirely of the central opening 216. The first and second side beams 212, 214 may be mirror images of each other. The frame 202 is disposed about an outer periphery 218 of the plate 204.

Figure 11:
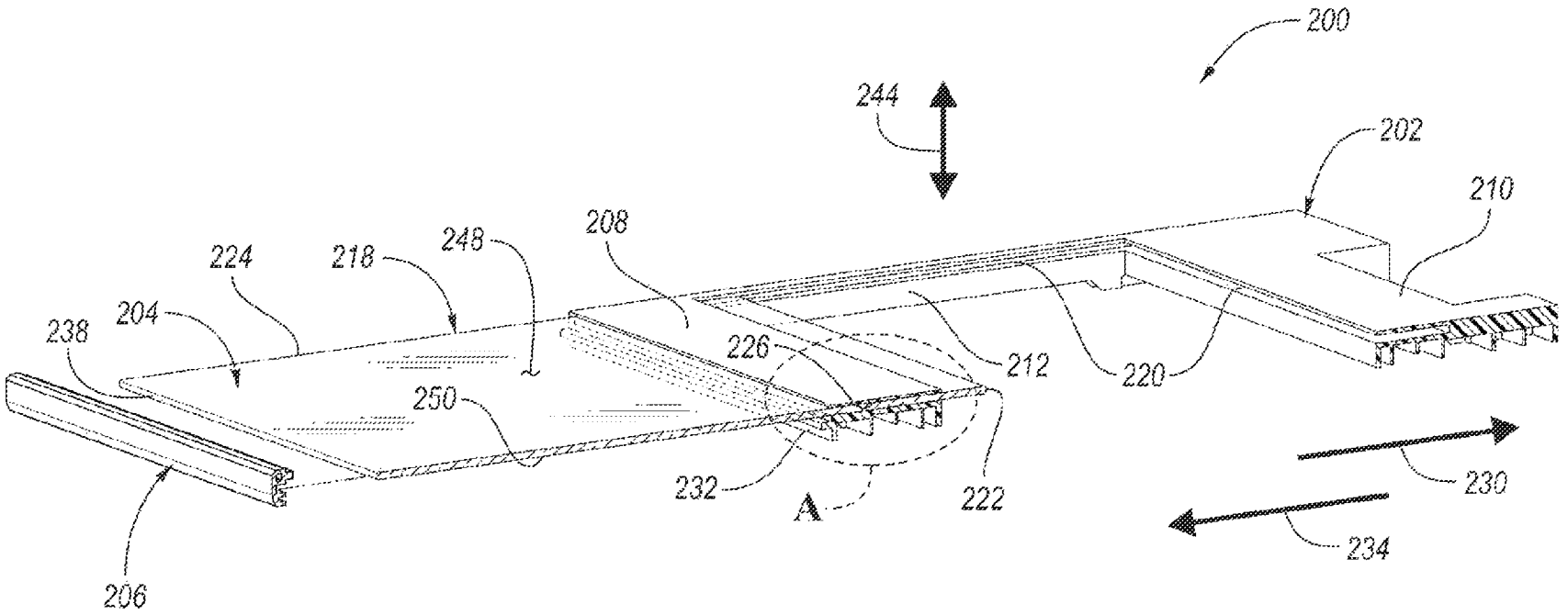
FIG. 11 is a cross-sectional view taken along line 11-11 in FIG. 9 illustrating a partially installed position of a support plate of the shelf.
Figure 12:
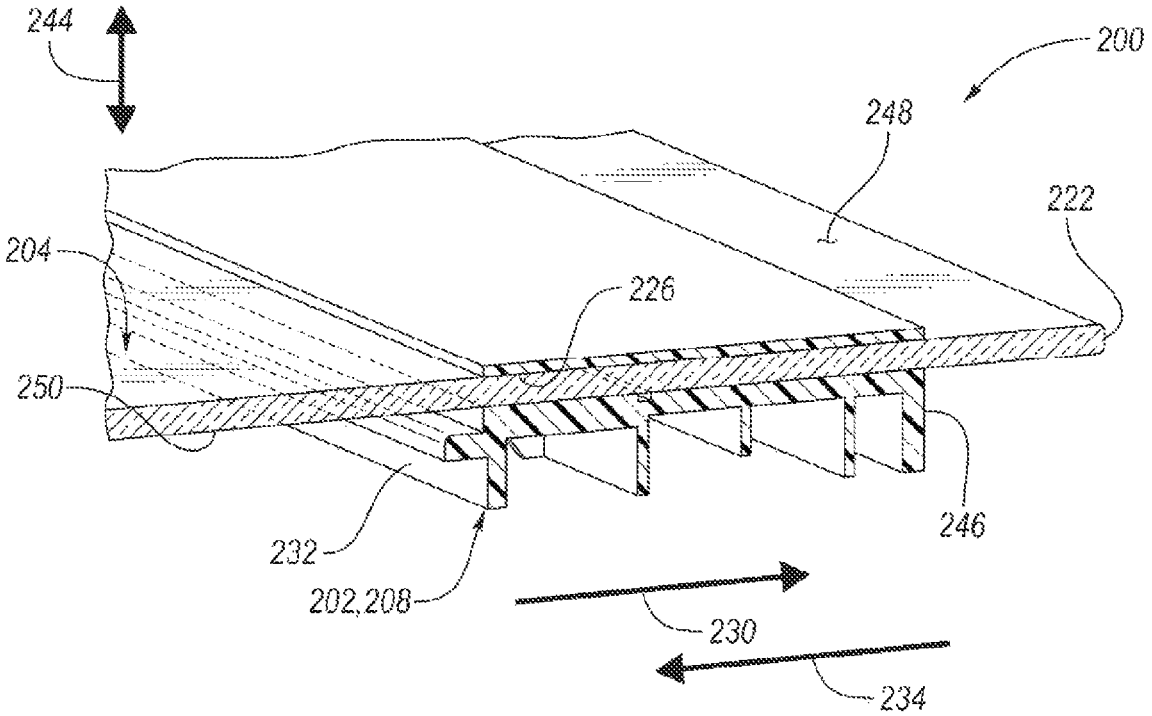
FIG. 12 is a magnified view of area A in FIG. 11.
Figure 13:
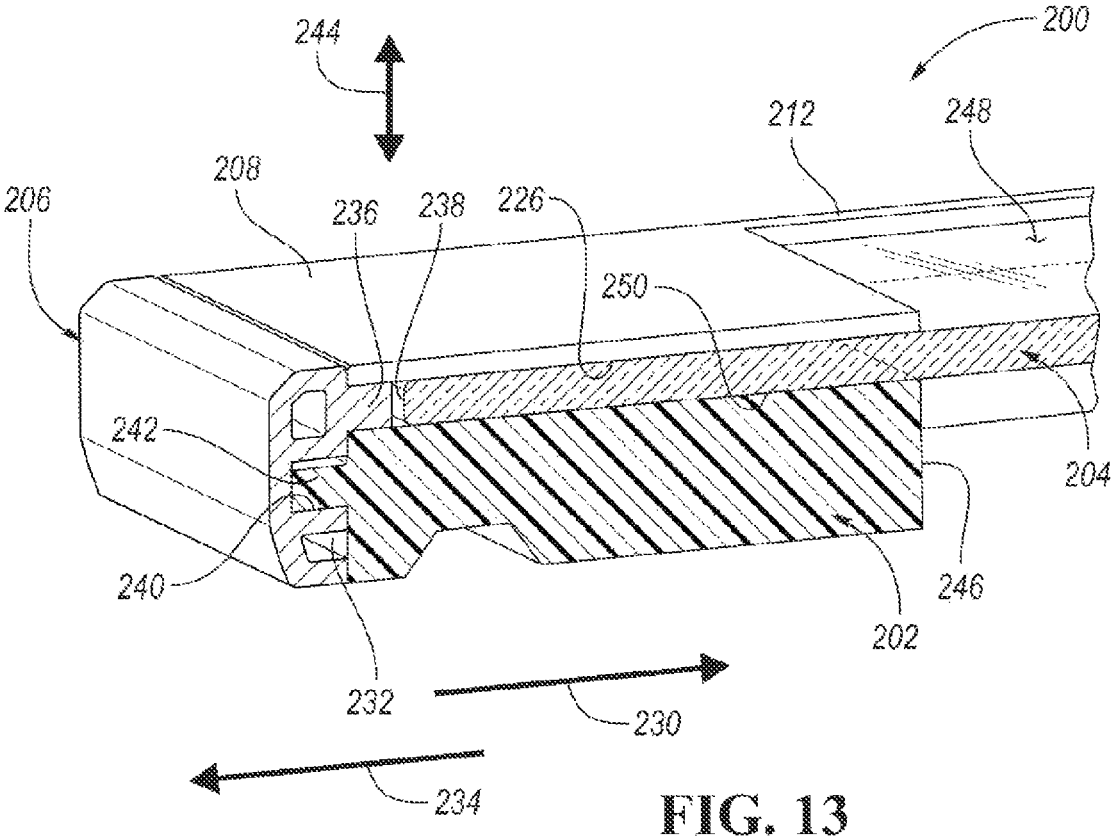
FIG. 13 is a cross-sectional view taken along line 13-13 in FIG. 9.
Figure 14:
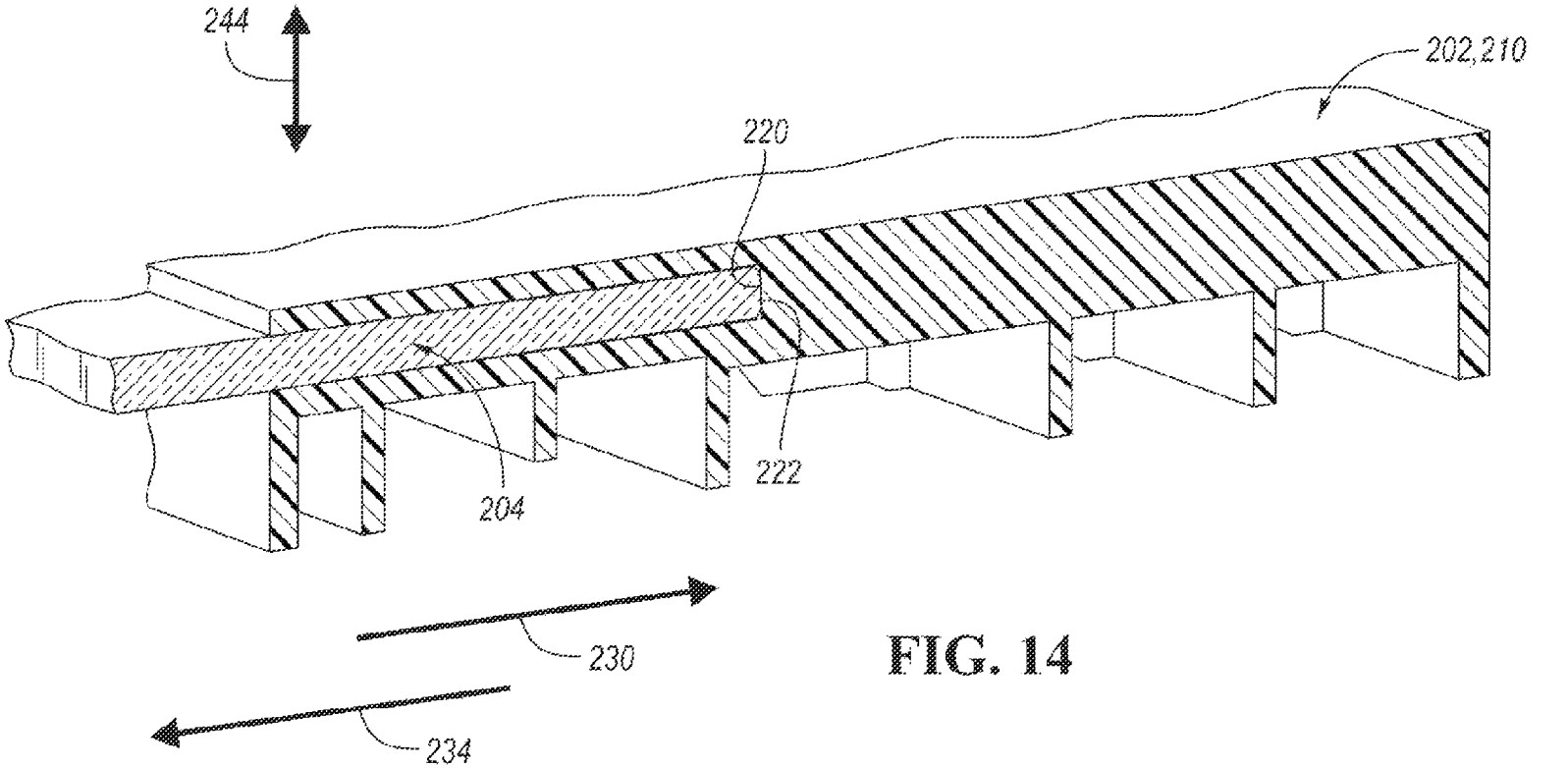
FIG. 14 is a cross-sectional view taken along line 14-14 in FIG. 9.
Figure 15:
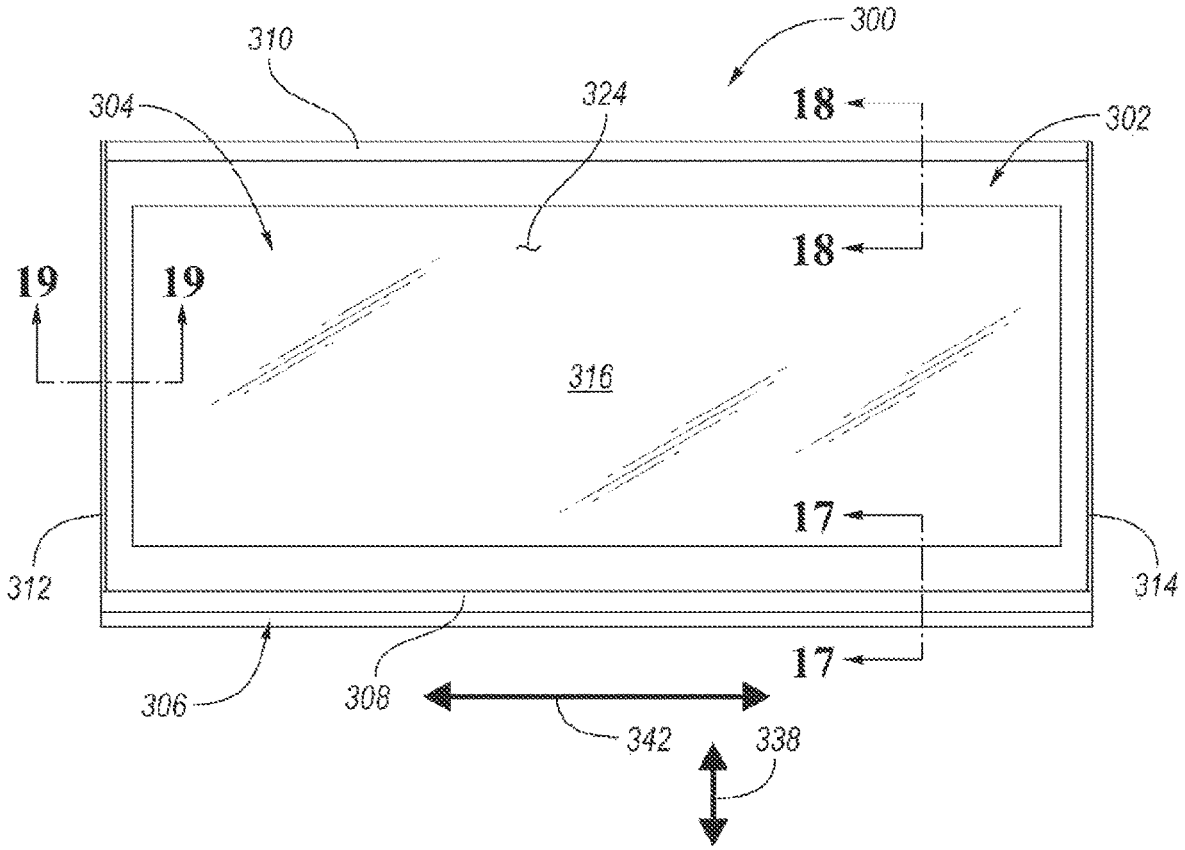
FIG. 15 is a top view of a third embodiment of a refrigerator shelf.
Figure 16:
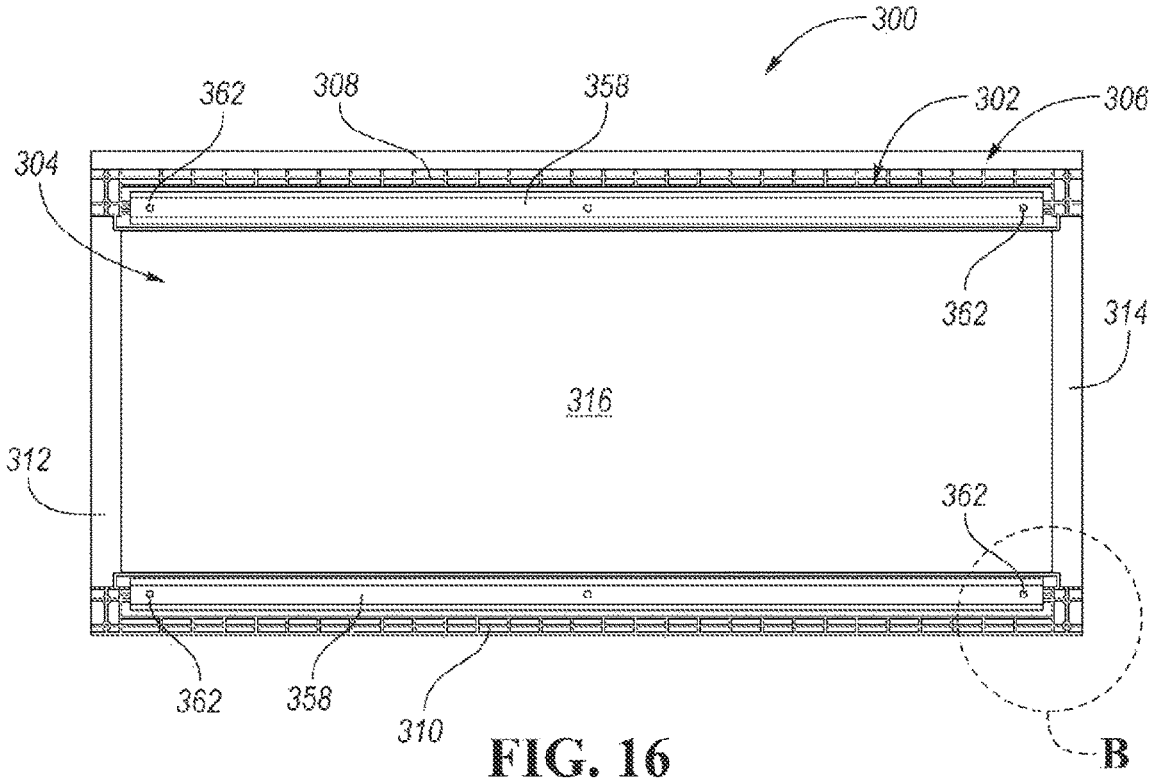
FIG. 16 is a bottom view of the third embodiment of the refrigerator shelf.
Figure 17:
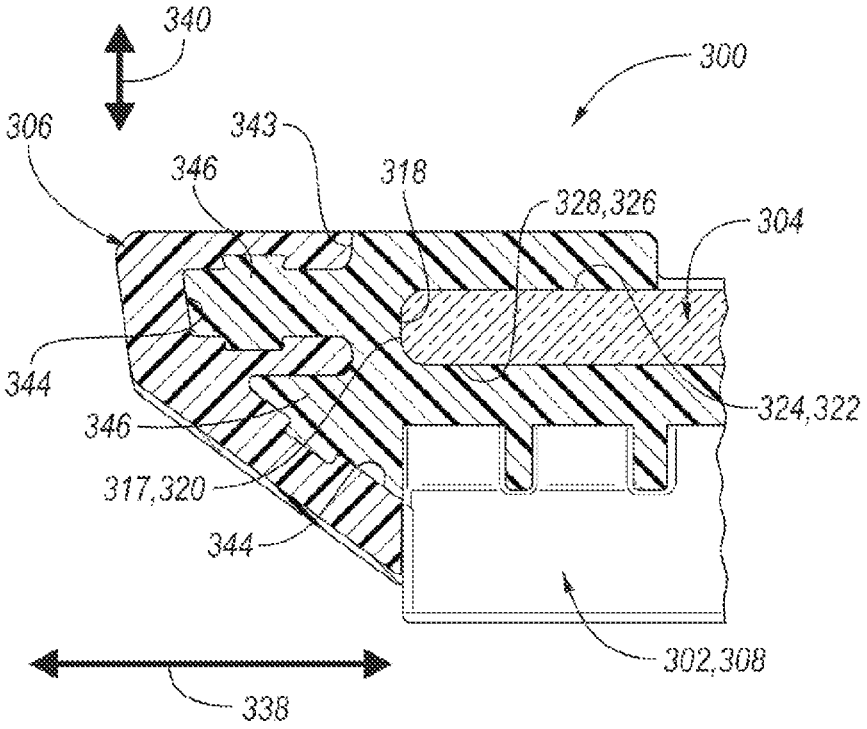
FIG. 17 is a cross-sectional view taken along line 17-17 in FIG. 15.
Figure 18:
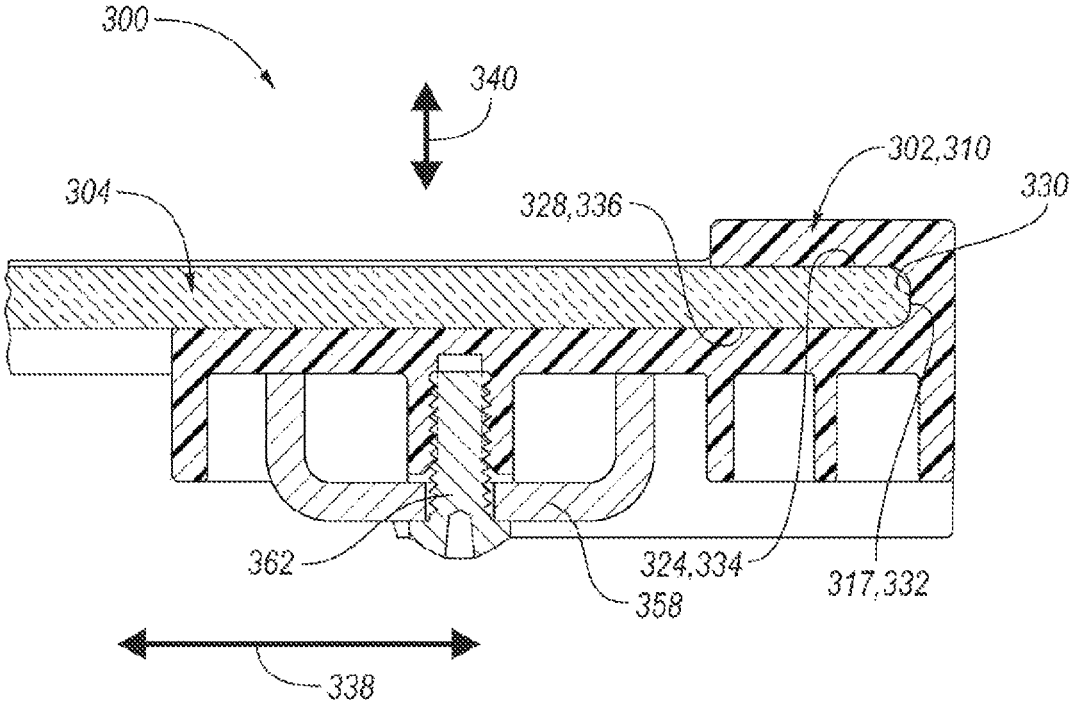
FIG. 18 is a cross-sectional view taken along line 18-18 in FIG. 15.
Figure 20:
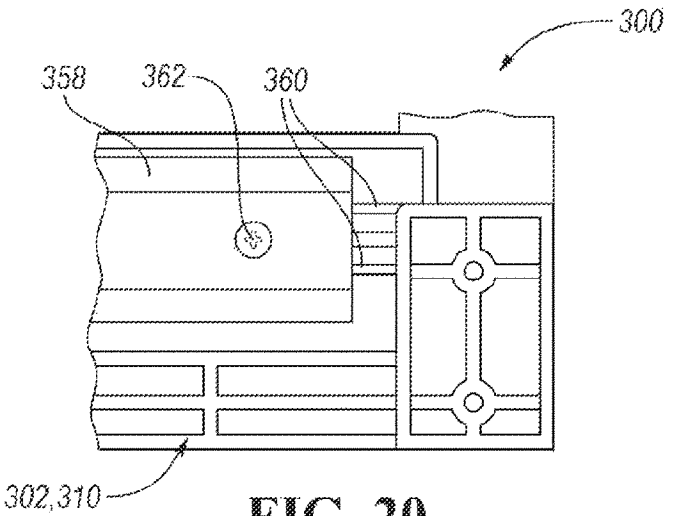
FIG. 20 is a magnified view of area B in FIG. 16.
Figure 22:
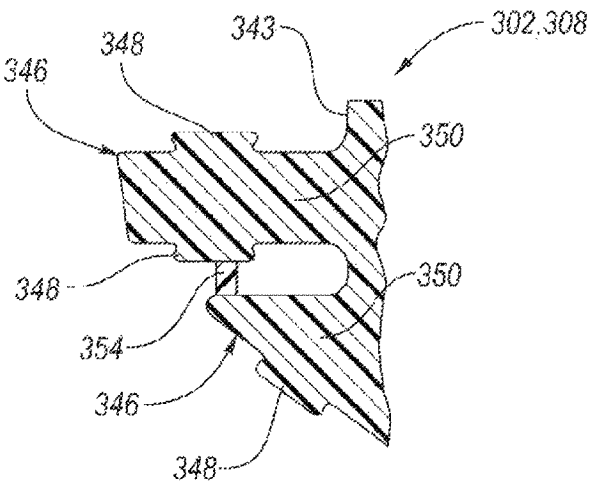
FIG. 22 is a side view of a portion of the front edge of the third embodiment of the refrigerator shelf.

The rear beam 210, first side beam 212, and second side beam 214 collectively define a C-channel 220 configured to receive the plate 204. More specifically, the C-channel 220 is configured to receive a rearward edge 222 and side edges 224 of the plate 204. The outer periphery 218 of the plate 204 may include the rearward edge 222, a forward edge 238, and the side edges 224 of the plate 204. The front beam 208 defines a slot 226 configured to guide the plate 204 in a direction 230 extending from the front beam 208 toward the rear beam 210 and into the C-channel 220 during installation. The plate 204 is disposed within the C-channel 220 and is disposed at least partially in the slot 226 upon installation of the plate 204 onto the frame 202. It is noted that the second side beam 214 may have the same structure as the first side beam 212 and any corresponding components (e.g., C-channel 220, plate 204, etc.) may be part of or interact with the second side beam 214 similar to what is illustrated in FIGS. 11 and 13, with the exception being that the second side beam 214 may be a mirror image of the first side beam 212.

The edge cover 206 is secured to a forward edge 232 of the front beam 208 and covers the slot 226 along the forward edge 232 of the front beam 208 (*i*) such that the edge cover 206 restricts movement of the plate 204 out of the slot and in a direction 234 extending from the rear beam 210 toward the front beam 208, and (ii) such that the edge cover 206 secures the position of the plate 204 within the C-channel 220 and slot 226. The edge cover 206 may include a protrusion 236 extending into the slot 226 along the forward edge 232 of the front beam 208. The protrusion 236 is configured to engage a forward edge 238 of the plate 204 to restrict movement of the plate 204 in the direction 234 extending from the rear beam 210 toward the front beam 208. The edge cover 206 may define a second slot 240. The front beam 208 may include a second protrusion 242 extending from the forward edge 232 and into the second slot 240. The engagement between the second protrusion 242 and the second slot 240 may be configured to locate the edge cover 206 relative to the front beam 208 and restrict movement of the edge cover 206 relative to the front beam 208 in a vertical direction 244. The edge cover 206 may be secured to the front beam 208 (or more generally to the frame 202) via (i) an adhesive disposed between one or more of the contacting or opposing surfaces of the edge cover 206 and the front beam 208 or (ii) an interference-fit or frictional interference between one or more aspects of the edge cover 206 and the front beam 208 (e.g., engagement between the protrusion 236 and the slot 226 may be an interference-fit and/or engagement between the second protrusion 242 and the second slot 240 may be an interference-fit).

The edge cover 206 may extend between and span a distance between first and second side beams 212, 214. The slot 226 may also extend between and span the distance between first and second side beams 212, 214. The slot may also extend between the forward edge 232 of the front beam 208 and a rearward edge 246 of the front beam 208. When the plate 204 is installed onto the frame 202, the front beam 208 is disposed over a top or top surface 248 of the plate 204 and below a bottom or bottom surface 250 of plate 204, and the cover 206 is disposed along the forward edge 238 of the plate 204.

Referring to FIGS. 15-22, a third embodiment of a refrigerator shelf 300 is illustrated. The shelf 300 may be utilized as a shelf within a compartment of the refrigerator 10 (e.g., the fresh food compartment 12 or the freezer compartment 14). For example, the shelf 300 may be utilized as shelf 15 illustrated in FIG. 2. The shelf 300 includes a frame 302, a panel or plate 304 (e.g., a glass plate) that is configured to support items (e.g., food items) that are disposed within the refrigerator 10, and a trim or edge cover 306. The frame 302 provides structural support for the plate 304 and has a configuration so that the top surface area of the plate 304 is maximized (which maximizes the number of items that may be placed on the top of the plate 304) and so that the plate 304 has sufficient structure to support the load of the items placed on the top of the plate 304. This configuration allows for a single shelf having a single support plate (as opposed to multiple spaced-apart shelves or plates) to be utilized, where the single shelf may span an entire width of a compartment of the refrigerator 10 (e.g., the fresh food compartment 12 or the freezer compartment 14).

The frame 302 includes a front beam 308, a rear beam 310, a first side beam 312, and a second side beam 314. A bottom of the frame 302 (including bottoms of each of the front beam 308, rear beam 310, first side beam 312, and second side beam 314) may include ribs that increase the structural rigidity of the frame 302. The front beam 308 is spaced-apart from the rear beam 310. The first side beam 312 is spaced-apart from the second side beam 314. The front beam 308 and rear beam 310 each span and are each secured to the first and second side beams 312, 314 such that a central opening 316 is defined between the front beam 308, rear beam 310, first side beam 312, and second side beam 314. The plate 304 spans the front beam 308 and rear beam 310, and spans first and second side beams 312, 314 such that the plate 304 is disposed within an entirely of the central opening 316. The front beam 308, the rear beam 310, the first side beam 312, and the second side beam 314 collectively encapsulate an entirety of an outer peripheral edge 317 of the plate 304. The first and second side beams 312, 314 may be mirror images of each other.

The front beam 308 defines a first C-channel 318 engaging a first portion 320 of the outer peripheral edge 317 of the plate 304, a first portion 322 of an upper surface 324 of the plate 304, and a first portion 326 of a lower surface 328 of the plate 304. The rear beam 310 defines a second C-channel 330 engaging a second portion 332 of the outer peripheral edge 317 of the plate 304, a second portion 334 of the upper surface 324 of the plate 304, and a second portion 336 of the lower surface 328 of the plate 304.

The first C-Channel 318 and the second C-channel 330 are configured to restrict movement of the plate 304 in a direction 338 extending between the front beam 308 and the rear beam 310. The first C-Channel 318 and the second C-channel 330 are also configured to restrict movement of the plate 304 in the vertical direction 340. Engagement between the outer peripheral edge 317 of the plate 304 and the first and second side beams 312, 314 is configured to restrict movement of the plate in a direction 342 extending between the first and second side beams 312, 314. The frame 302 may be overmolded onto the plate 304 such that the front beam 308, the rear beam 310, the first side beam 312, and the second side beam 314 are integrally formed as a single component.

The edge cover 306 may be secured to a forward edge 343 of the font beam 308. The edge cover 306 defines keyed-orifices 344. The front beam 308 includes keyed-protrusions 346 that engage the keyed-orifices 344 to secure the edge cover 306 to the front beam 308. The keyed-protrusions 346 may include branches 348 that may extend in a plurality of directions from a base portion 350 of the keyed-protrusions 346. The edge cover 306 may define apertures 352 extending between the keyed-orifices 344. The front beam 308 may be overmolded onto to the edge cover 306 such that the front beam 308 includes ribs 354 that extend through the apertures 352 and between the keyed-protrusions 346. The ribs 354 span a distance between and may be secured to each of the key-protrusions 346. The edge cover 306 may be retained on the front beam 308 by the ribs 354 extending through the apertures 352. The ribs 354 are designed to withstand the force required to retain the edge cover 306 on the front beam 308.

Figure 19:
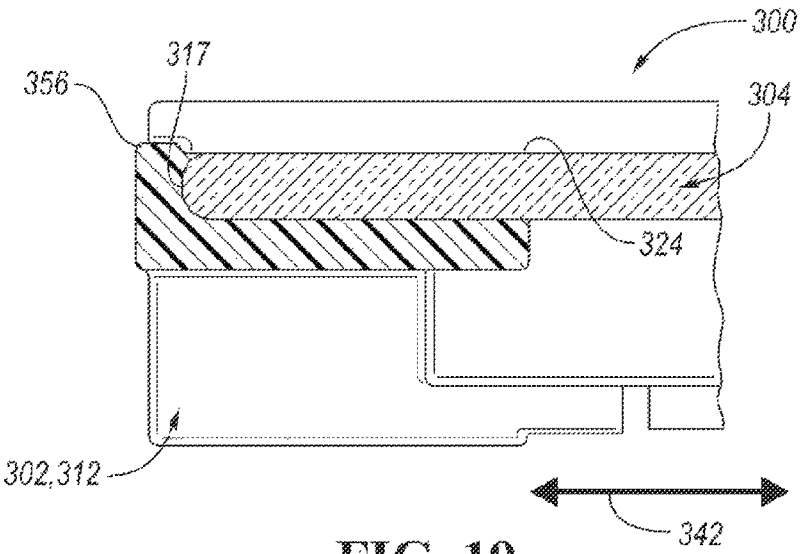
FIG. 19 is a cross-sectional view taken along line 19-19 in FIG. 15.
Figure 21:
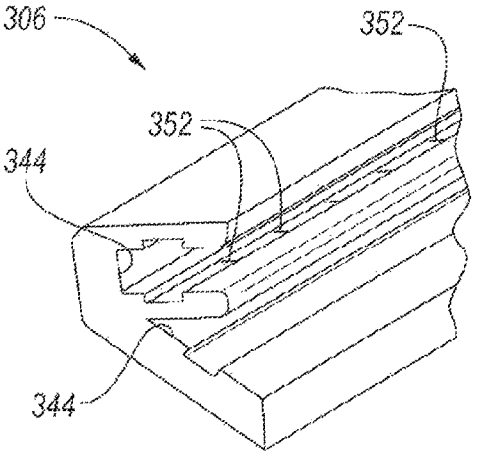
FIG. 21 is an isometric side view of a portion of an edge cover that is secured to a front edge of a frame of the third embodiment of the refrigerator shelf.

The first and second side beams 312, 314 may include extensions, protrusions, or ridges 356 that extend above the upper surface 324 of the plate 304. Portions of the front beam 308 and rear beam 310 that define the first C-Channel 318 and the second C-channel 330, respectively, may also extend above the upper surface 324 of the plate 304. These portions of the front beam 308, a rear beam 310, a first side beam 312, and a second side beam 314 that extend above the upper surface 324 of the plate 304 operate to retain any fluid that may have been spilled onto the upper surface 324 of the plate 304. It is noted that the second side beam 314 may have the same structure as the first side beam 312 and any corresponding components (e.g., ridge 356, plate 304, etc.) may be part of or interact with the second side beam 314 similar to what is illustrated in FIG. 19, with the exception being that the second side beam 314 may be a mirror image of the first side beam 312.

Support braces or support bars 358 may be secured to the bottom of the frame 302. The support braces or support bars 358 provide additional rigidity to the frame to support any items that have been placed onto the plate 304. The support braces or support bars 358 may also operate to carry a portion of the load that has been placed onto the plate 304 any may operate to prevent or decrease deflection of the plate 304 due to the load placed onto the plate 304. Eliminating or reducing deflection of the plate 304 is desirable particularly if the plate is made from a material that is not elastic. Opposing stopper or locating ribs 360 may be positioned on each end of each support brace or support bar 358 to properly locate the support braces or support bars 358. The support braces or support bars 358 may be secured to the bottom of the frame 302 via fasteners 362. It is noted that locating ribs 360 may be positioned on each end of each end of each support brace or support bar 358 and that the locating ribs 360 on opposing side of each support brace or support bar 358 may be mirror images of each other. The support braces or support bars 358 and the locating ribs 360 may also be included in the first embodiment of a refrigerator shelf 100 and the second embodiment of a refrigerator shelf 200.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelf comprising:

a plate configured to support items disposed within a refrigerator;

a frame configured to support the plate, the frame having a front beam, a rear beam, a first side beam, and a second side beam, wherein (i) the plate is disposed on top of an upper surface that is collectively formed by the front beam, the rear beam, the first side beam, and the second side beam and (ii) the rear beam defines a C-channel above the upper surface receiving a rearward edge of the plate to restrict movement of the plate in a vertical direction and to restrict movement of the plate in a direction extending from the front beam toward the rear beam; and a cover (i) engaging a forward edge of the front beam, (ii) engaging a forward edge of the plate to restrict movement of the plate in a direction extending from the rear beam toward the front beam, and (iii) having an overhang engaging a top of the plate to further restrict movement of the plate in the vertical direction, wherein the cover is disposed between opposing tabs that extend forward from the first and second side beams.

2. The refrigerator shelf of claim 1, wherein ridges extend upward from the upper surface along edges of the first and second side beams.

3. The refrigerator shelf of claim 2, wherein the ridges engage lateral edges of the plate to restrict movement of the plate in a direction extending between the first and second side beams.

4. The refrigerator shelf of claim 1, wherein the cover is secured to the opposing tabs via fasteners extending into lateral sides of the cover.

5. The refrigerator shelf of claim 4, wherein the cover defines orifices configured to receive the fasteners.

6. The refrigerator shelf of claim 4, wherein the fasteners are self-tapping fasteners.

7. The refrigerator shelf of claim 1 further comprising structural ribs protruding from a bottom of the frame.

8. A refrigerator shelf comprising:

a plate configured to support items disposed within a refrigerator;

a frame disposed about a periphery of the plate, the frame having a front beam, a rear beam, a first side beam, and a second side beam, wherein (i) the front beam is spaced-apart from the rear beam, (ii) the first side beam is spaced-apart from the second side beam, (iii) the front beam and rear beam each span and are each secured to the first and second side beams such that a central opening is defined between the front beam, rear beam, first side beam, and second side beam, (iv) the rear beam, first side beam, and second side beam collectively define a C-channel configured to receive the plate, (v) the front beam defines a slot configured to guide the plate in a direction extending from the front beam toward the rear beam and into the C-channel during installation, (vi) the plate is disposed within the C-channel and at least partially in the slot, (vii) the plate spans the front beam and rear beam and spans first and second side beams such that the plate is disposed within an entirely of the central opening; and a cover secured to a forward edge of the front beam and covering the slot such that the cover (i) restricts movement of the plate out of the slot and in a direction extending from the rear beam toward the front beam and (ii) secures a position of the plate within the C-channel and slot.

9. The refrigerator shelf of claim 8, wherein the cover includes a protrusion extending into the slot along the forward edge of the front beam, wherein the protrusion is configured to engage a forward edge of the plate to restrict movement of the plate in the direction extending from the rear beam toward the front beam.

10. The refrigerator shelf of claim 8, wherein the cover defines a second slot and the front beam includes a second protrusion extending into the second slot, wherein an engagement between the second protrusion and the second slot is configured to locate the cover relative to the front beam and restrict movement of the cover relative to the front beam in a vertical direction.

11. The refrigerator shelf of claim 8, wherein the cover spans a distance between first and second side beams.

12. The refrigerator shelf of claim 8, wherein the slot extends from the first side beam to the second side beam.

13. The refrigerator shelf of claim 12, wherein the slot extends from the forward edge of the front beam to a rearward edge of the front beam.

14. The refrigerator shelf of claim 12, wherein (i) the front beam is disposed over a top of the plate and below a bottom of plate and (ii) the cover is disposed along a forward edge of the plate.

15. A refrigerator shelf comprising:

a plate configured to support items disposed within a refrigerator;

a frame configured to support the plate, the frame having a front beam, a rear beam, a first side beam, and a second side beam, wherein the front beam engages a portion of the outer peripheral edge of the plate; and an edge cover secured to a forward edge of the front beam, wherein (i) the edge cover defines keyed-orifices and (ii) the front beam includes keyed-protrusions that engage the keyed-orifices to secure the edge cover to the front beam, wherein the edge cover defines apertures extending between the keyed-orifices, and wherein the front beam is overmolded onto to the edge cover such that the front beam includes ribs that extend through the apertures and between the keyed-protrusions.

16. The refrigerator shelf of claim 15, wherein the frame is overmolded onto the plate such that the front beam, the rear beam, the first side beam, and the second side beam are integrally formed as a single component.

17. The refrigerator shelf of claim 15, wherein the front beam, the rear beam, the first side beam, and the second side beam collectively encapsulate an entirety of an outer peripheral edge of the plate.

18. The refrigerator shelf of claim 17, wherein (i) the front beam defines a first C-channel engaging a first portion of the outer peripheral edge of the plate, a first portion of an upper surface of the plate, and a first portion of a lower surface of the plate and (ii) the rear beam defines a second C-channel engaging a second portion of the outer peripheral edge of the plate, a second portion of the upper surface of the plate, and a second portion of the lower surface of the plate, wherein the first and second C-channels are configured to (a) restrict movement of the plate in a direction extending between the front beam and the rear beam and (b) restrict movement of the plate in a vertical direction, and wherein engagement between the outer peripheral edge of the plate and the first and second side beams is configured to restrict movement of the plate in a direction extending between the first and second side beams.

19. The refrigerator shelf of claim 15, wherein the keyed-protrusions include branches extending in a plurality of directions.

20. The refrigerator shelf of claim 15 further comprising structural ribs protruding from a bottom of the frame.

* * * * *